US011545328B2

(12) United States Patent
Sakai

(10) Patent No.: US 11,545,328 B2
(45) Date of Patent: Jan. 3, 2023

(54) IRRADIATION CONTROL DEVICE FOR CHARGED PARTICLES

(71) Applicant: SUMITOMO HEAVY INDUSTRIES, LTD., Tokyo (JP)

(72) Inventor: Hiromichi Sakai, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 26 days.

(21) Appl. No.: 17/208,047

(22) Filed: Mar. 22, 2021

(65) Prior Publication Data

US 2021/0304999 A1 Sep. 30, 2021

(30) Foreign Application Priority Data

Mar. 24, 2020 (JP) ..... JP2020-053252

(51) Int. Cl.
*H01J 3/32* (2006.01)
*G21K 5/02* (2006.01)

(52) U.S. Cl.
CPC . *H01J 3/32* (2013.01); *G21K 5/02* (2013.01)

(58) Field of Classification Search
CPC ..... H01J 3/32; G21K 5/02
USPC ..... 250/396 R, 397
See application file for complete search history.

(56) References Cited

U.S. PATENT DOCUMENTS 6,313,184 B1 * 11/2001 Sasaki ..... C08J 9/18 521/142
11,024,437 B2 6/2021 Park, Jr. et al.
2004/0190682 A1 * 9/2004 Deuringer ..... H05G 1/52 378/137
2004/0196082 A1 * 10/2004 Pacha ..... H03K 3/356139 327/215
2008/0043916 A1 * 2/2008 Lemaitre ..... H05G 1/52 378/138
2018/0263945 A1 9/2018 James et al.
2020/0037430 A1 1/2020 Park, Jr. et al.
2021/0345983 A1 * 11/2021 Rogers ..... A61B 6/035

FOREIGN PATENT DOCUMENTS

CN 107890611 A 4/2018
EP 2 600 356 A1 6/2013
JP 2011-237301 A 11/2011
JP 5490608 B2 5/2014
TW I480892 B 4/2015
TW 201706008 A 2/2017

OTHER PUBLICATIONS

Office Action for Taiwanese Application No. 110109685, dated Jul. 15, 2022.

* cited by examiner

*Primary Examiner* — Nicole M Ippolito
(74) *Attorney, Agent, or Firm* — Michael Best & Friedrich LLP

(57) ABSTRACT

An irradiation control device which controls irradiation of charged particles to a target that includes a substance that generates neutrons by being irradiated with a charged particle beam, includes: a deflector that deflects the charged particles; and a controller that controls the deflector such that a plurality of peaks of heat density formed by the beam are formed between a center of an irradiation surface of the target and an end portion of the irradiation surface by moving the beam of the charged particles on the irradiation surface.

9 Claims, 5 Drawing Sheets

IRRADIATION CONTROL DEVICE FOR CHARGED PARTICLES

RELATED APPLICATIONS

The content of Japanese Patent Application No. 2020-053252, on the basis of which priority benefits are claimed in an accompanying application data sheet, is in its entirety incorporated herein by reference.

BACKGROUND

Technical Field

Certain embodiments of the present disclosure relate to an irradiation control device for charged particles.

Description of Related Art

In the related art, there is shown a technique for causing a beam of charged particles to orbit on an irradiation surface of a target surface when irradiating the target with the charged particles. Specifically, the related art discloses that the diameter of the beam of charged particles is about ½ of the diameter of the target and that an orbit trajectory of the center of the beam of charged particles is a circular trajectory centered on the center of the target and having a radius of about ¼ of the diameter of the target.

SUMMARY

According to an embodiment of the present disclosure, there is provided an irradiation control device which controls irradiation of charged particles to a target that includes a substance that generates neutrons by being irradiated with a charged particle beam, including: a deflector that deflects the charged particles; and a controller that controls the deflector such that a plurality of peaks of heat density formed by the beam are formed between a center of an irradiation surface of the target and an end portion of the irradiation surface by moving the beam of the charged particles on the irradiation surface.

DETAILED DESCRIPTION

Figure 1:
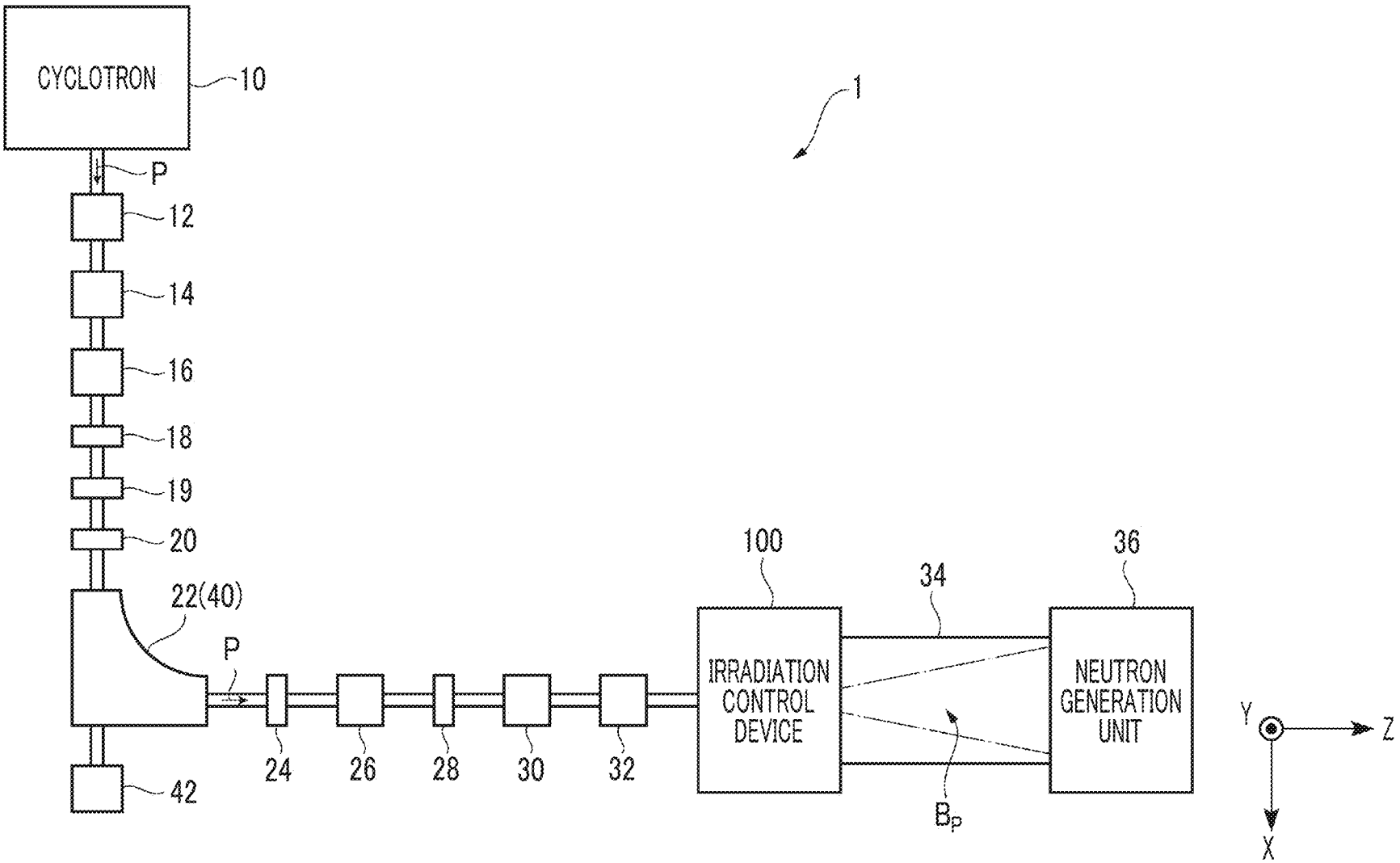
FIG. 1 is a diagram showing a configuration of a neutron generating apparatus provided with an irradiation control device for charged particles according to an embodiment.

In recent years, it has been required to increase a beam current related to the beam of charged particles. However, in the method described in the related art, since the distribution of input heat to the target is uneven, there is a possibility that the target may be locally subjected to a high heat load, and thus it is considered that it is difficult to increase the beam current.

It is desirable to provide a technique capable of making heat density related to input heat to a target more uniform.

According to the irradiation control device for charged particles, a plurality of peaks of the heat density formed by the beam are formed between the center and the end portion of the irradiation surface of the target by moving the beam of charged particles on the irradiation surface of the target. As a result, the heat density related to the input heat to the target by the sum of beam irradiations with respect to the irradiation surface can be made more uniform.

The controller may control the deflector to make a diameter of the beam of the charged particles smaller than a radius of the target.

In a case where the diameter of the beam is smaller than the radius of the target, the irradiation region with the beam can be more finely adjusted. Therefore, it is possible to make the heat density related to the input heat to the target by the sum of long-time irradiations more uniform.

The controller may control the deflector to change a movement speed of the beam or the number of times of irradiations of the same irradiation region between the center side and the end portion side of the irradiation surface.

The movement speed of the beam and the number of times of irradiations of the same irradiation region affect the heat density related to the input heat to the target. Therefore, by changing the movement speed of the beam or the number of times of irradiations of the same irradiation region, the heat density related to the input heat to the target can be adjusted to be more uniform.

According to the present disclosure, a technique capable of making heat density related to input heat to a target more uniform is provided.

Hereinafter, an embodiment of the present disclosure will be described in detail with reference to the accompanying drawings. In the description of the drawings, the same elements are denoted by the same reference numerals, and overlapping description is omitted.

Figure 2:
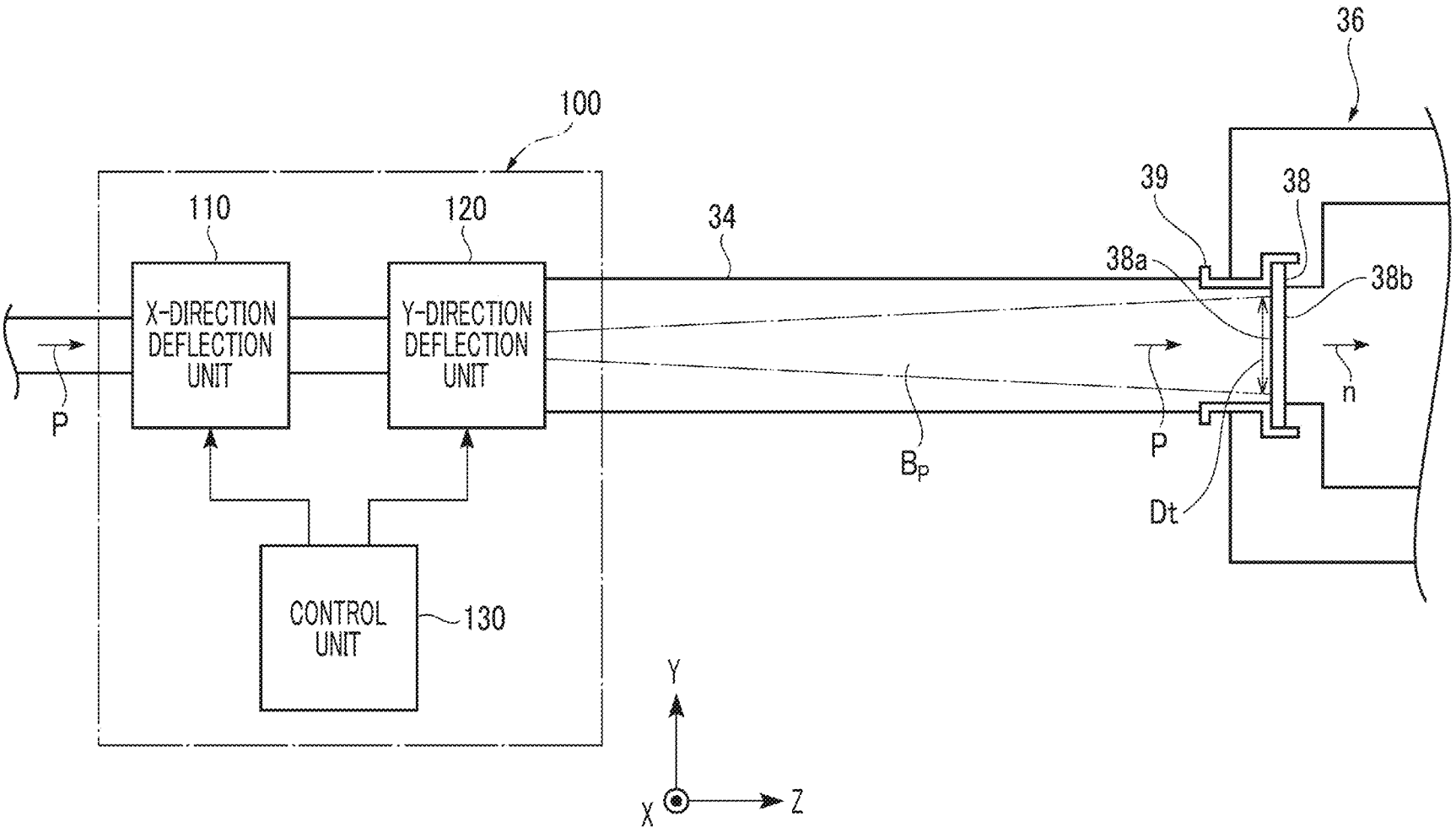
FIG. 2 is a diagram showing a configuration of the irradiation control device for charged particles according to an embodiment.
Figure 3:
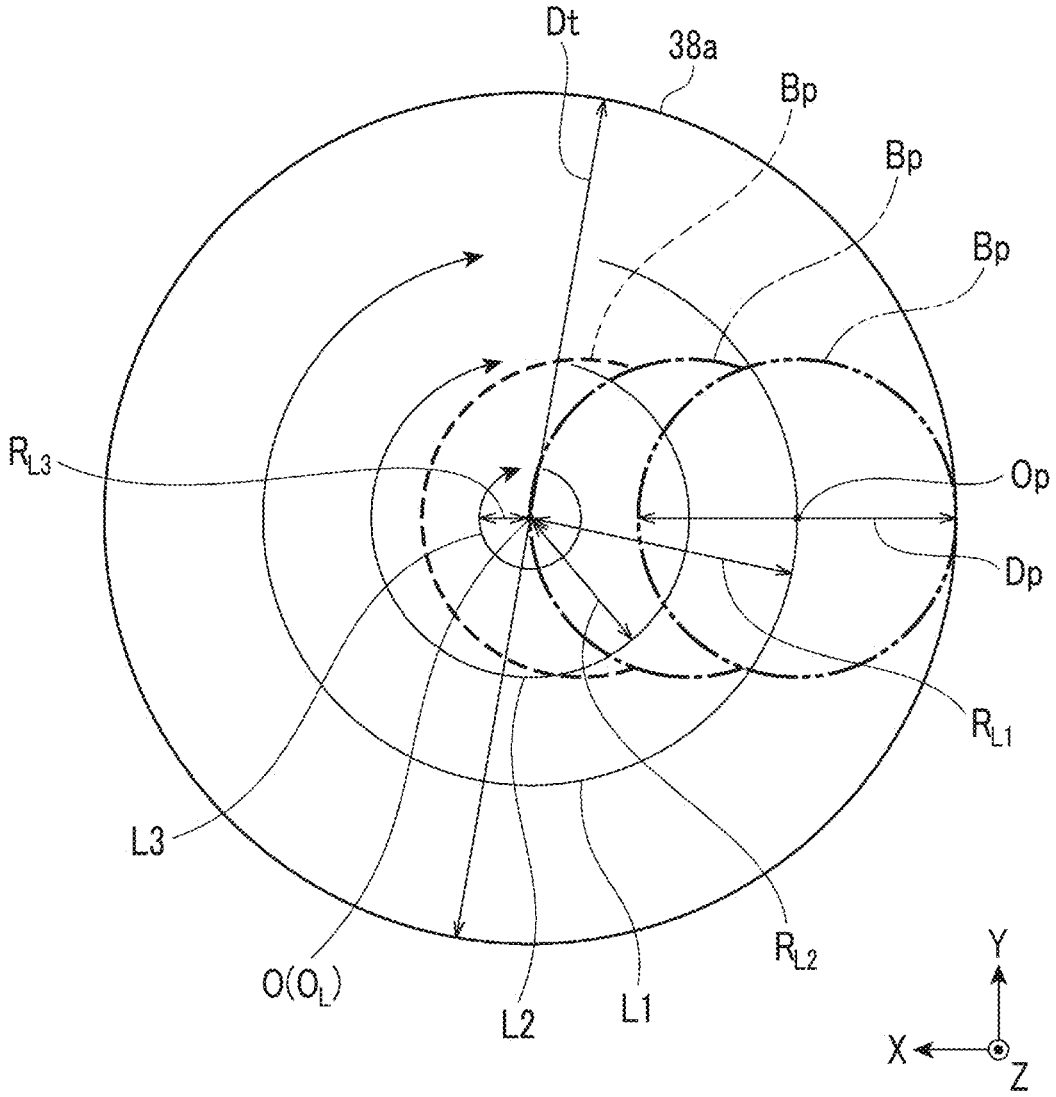
FIG. 3 is a diagram showing an example of an irradiation control method for charged particles with respect to an irradiation surface of a target.

FIG. 1 is a diagram showing the configuration of a neutron generating apparatus provided with an irradiation control device for charged particles according to an embodiment of the present disclosure, and FIG. 2 is a diagram showing the configuration of the irradiation control device for charged particles according to the embodiment of the present disclosure. Further, FIG. 3 is a diagram showing an example of an irradiation control method for charged particles with respect to an irradiation surface of a target.

A neutron generating apparatus 1 shown in FIG. 1 is an apparatus that is used for performing cancer treatment or the like using neutron capture therapy such as boron neutron capture therapy (BNCT), for example.

The neutron generating apparatus 1 is provided with an accelerator such as a cyclotron 10. The accelerator accelerates charged particles such as protons to produce a particle beam. The cyclotron 10 has the ability to generate a proton beam having a beam diameter of 40 mm and 60 kw (=30 MeV×2 mA), for example.

A beam (charged particle beam) of ions (hereinafter referred to as charged particles) P such as protons or deuterons extracted from the cyclotron 10 sequentially passes through, for example, a horizontal steering 12, a four-way slit 14, a horizontal and vertical steering 16, magnets 18, 19, and 20, a 90-degree bending electromagnet 22, a magnet 24, a horizontal and vertical steering 26, a magnet 28, a four-way slit 30, a CT monitor 32, an irradiation control device 100, and a beam duct 34, and is led to a neutron generation unit 36.

The horizontal steering 12 and the horizontal and vertical steering 16 and 26 are for adjusting a beam axis of the charged particles P by using, for example, an electromagnet. Similarly, the magnets 18, 19, 20, 24, and 28 are for adjusting the beam axis of the charged particles P by using, for example, an electromagnet. The four-way slits 14 and 30 are for performing beam shaping of the charged particles P by cutting the beam at the end. The 90-degree bending electromagnet 22 is for deflecting an advancing direction of the charged particles P by 90 degrees. The CT monitor 32 is for monitoring a beam current value of the charged particles P.

The neutron generation unit 36 has a target 38 whose irradiation surface 38*a* is irradiated with the charged particles P to generate neutrons n from an exit surface 38*b*, as shown in FIG. 2. The target 38 is made of a substance that generates neutrons by irradiation with the charged particles P such as beryllium (Be), and an outer peripheral portion thereof is fixed to a target fixing portion 39 with bolts or the like. A region on the beam irradiation surface side, which is not fixed by the target fixing portion 39, (a region on the inner periphery side that is not covered with the target fixing portion 39) may be the irradiation surface 38*a* for the charged particles P. An effective diameter Dt of beam irradiation on the irradiation surface 38*a* is, for example, 220 mm in diameter. A patient is irradiated with the neutrons n generated in the neutron generation unit 36.

Further, the 90-degree bending electromagnet 22 is provided with a switching unit 40, and the switching unit 40 makes it possible to remove the charged particles P from a regular trajectory to be led to a beam dump 42. The beam dump 42 is for confirming the output of the charged particles P before treatment or the like.

Next, the irradiation control device 100 and the irradiation control method for charged particles according to this embodiment will be described with reference to FIGS. 2 and 3. The irradiation control device 100 is a device that controls the irradiation of the charged particles P with respect to the target 38, and includes an X-direction deflection unit 110, a Y-direction deflection unit 120, and a control unit 130 (controller). The X-direction deflection unit 110 and the Y-direction deflection unit 120 function as a deflector that deflects the charged particles P.

The X-direction deflection unit 110 is provided with, for example, an electromagnet, and deflects and emits the incident charged particles P in an X direction. Similarly, the Y-direction deflection unit 120 is provided with, for example, an electromagnet, and deflects and emits the incident charged particles P in a Y-direction. The X-direction deflection unit 110 and the Y-direction deflection unit 120 are controlled by control unit 130.

The control unit 130 adjusts the diameter of a beam Bp of the charged particles P. As an example, as shown in FIG. 3, the control unit 130 adjusts a diameter Dp of the beam Bp of the charged particles P to about ½ or less of the effective diameter (minimum outer diameter width) Dt=220 mm of the target 38 on the irradiation surface 38*a* of the target 38. As an example, the diameter Dp is 220×3/8=82.5 mm (radius: 41.25 mm).

Further, the control unit 130 controls the X-direction deflection unit 110 and the Y-direction deflection unit 120 to cause the beam Bp of the charged particles P to orbit such that a center Op of the beam Bp of the charged particles P draws a circular trajectory having a predetermined radius with a center O of the irradiation surface 38*a* as a trajectory center $O_L$ on the irradiation surface 38*a* of the target 38. In this way, an annular region centered on the center O of the irradiation surface 38*a* on the irradiation surface 38*a* of the target 38 is irradiated with the beam Bp. Further, the control unit 130 causes the beam Bp of the charged particles P to orbit multiple times such that the center Op of the beam Bp of the charged particles P draws a plurality of circular trajectories having different radii with the center O of the irradiation surface 38*a* as the trajectory center OL. At this time, the control unit 130 determines radii R ($R_{L1}$, $R_{L2}$, . . . (described later)) of orbit trajectories such that a plurality of orbit trajectories that are drawn by the center Op of the beam Bp form multiple circles.

For example, in the example shown in FIG. 3, the control unit 130 first causes the center Op of the beam Bp of the charged particles P to orbit along a circular orbit trajectory L1. The trajectory center $O_L$ and radius $R_{L1}$ of the orbit trajectory L1 are respectively set to be the center O of the irradiation surface 38*a* of the target 38 and be 68.75 mm that is about 5/16 of the effective diameter Dt=220 mm of the irradiation surface 38*a*. Under such conditions, the center Op of the beam Bp of the charged particles P orbits along the orbit trajectory L1.

Next, the control unit 130 causes the center Op of the beam Bp of the charged particles P to orbit along a circular orbit trajectory L2. The trajectory center $O_L$ and radius $R_{L2}$ of the orbit trajectory L2 are respectively set to be the center O of the irradiation surface 38*a* of the target 38 and be 41.25 mm that is about 3/16 of the effective diameter Dt=220 mm of the irradiation surface 38*a*. Under such conditions, the center Op of the beam Bp of the charged particles P orbits along the orbit trajectory L2.

Next, the control unit 130 causes the center Op of the beam Bp of the charged particles P to orbit along a circular orbit trajectory L3. The trajectory center $O_L$ and radius $R_{L3}$ of the orbit trajectory L3 are respectively set to be the center O of the target 38 and be 13.75 mm that is about 1/16 of the effective diameter Dt=220 mm of the target 38. Under such conditions, the center Op of the beam Bp of the charged particles P orbits along the orbit trajectory L3.

As described above, by performing irradiation with the beam Bp of the charged particles P while causing the center Op of the beam Bp to orbit along the orbit trajectories having different radii, it is possible to make the heat density related to the input heat to the irradiation surface 38*a* of the target 38 substantially uniform regardless of a location on the surface of the target 38. In this embodiment, the expression "substantially uniform" means that the ratio of the minimum value to the maximumvalue of variation in heat density on the irradiation surface 38*a* of the target 38 is 50% or less. It can be said that when the ratio of the minimum value to the maximum value of the variation in heat density is 30% or less, the heat density is more uniform.

Figure 4:
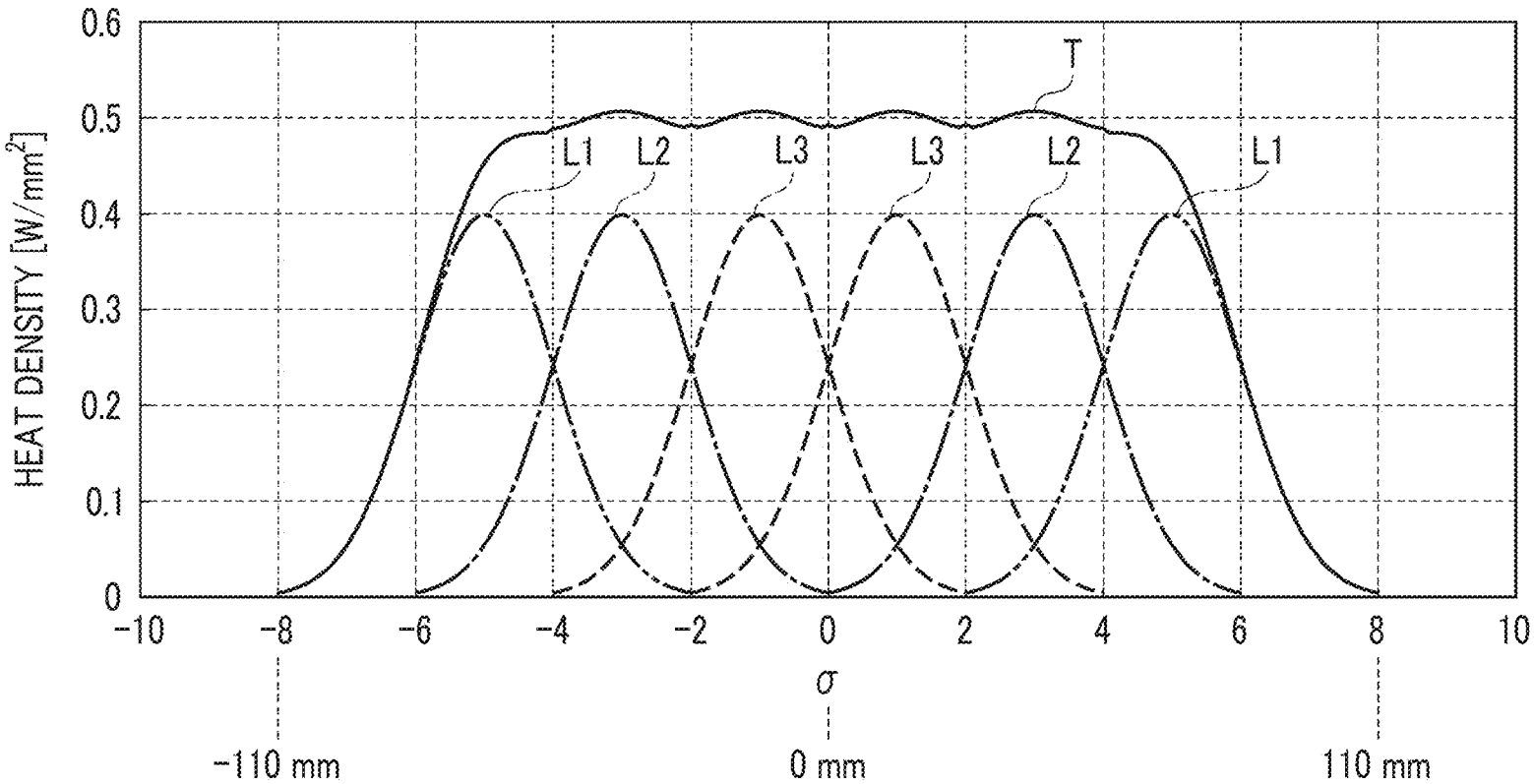
FIG. 4 is a diagram describing distribution of input heat by charged particles with respect to the irradiation surface of the target.

This point will be described with reference to FIGS. 4 and 5. FIG. 4 shows the distribution of the amount of input heat at each position when viewed in a diameter direction passing through the center O of the irradiation surface 38*a* of the target 38. The horizontal axis shows the outer edges of the effective diameter Dt=220 mm as +110 mm and −110 mm with the center of the target 38 as 0. Further, in FIG. 4, the effective diameter of the horizontal axis is set to be 16σ (radius 8σ) , and is shown as a range of −8σ to +8σ with the center O of the irradiation surface 38*a* as 0. In the example shown in FIG. 4, σ=13.75 mm, and +110 mm and −110 mm corresponding to the outer edges of the target 38 correspond to +8σ and −8σ, respectively. Further, in FIG. 4, the vertical axis represents heat density.

In the beam Bp of the charged particles P, the amount of input heat to the target 38 is different between the vicinity of the center thereof (the vicinity of the center Op) and the peripheral edge portion. Specifically, it is estimated that the heat density related to the input heat of the beam Bp on the irradiation surface 38*a* of the target 38 has normal distribution according to the radius from the center thereof. In such a case, a bias occurs in the heat density due to the beam Bp between the region corresponding to the vicinity of the center of the beam Bp and the region corresponding to the end portion of the beam Bp. When the diameter of the beam Bp of the charged particles increases, the heat density of the central portion also increases. However, the irradiation range of the beam Bp is adjusted such that the irradiation surface 38*a* of the target 38 is irradiated with the beam Bp, and therefore, when the diameter of the beam Bp increases, the amount of input heat at the center Op of the beam Bp becomes very larger than that at the peripheral edge of the beam Bp, and thus thermal stress or the like may occur.

On the contrary, as shown in FIG. 4, in a case where the irradiation surface 38*a* of the target 38 is irradiated with the beam Bp whose diameter Dp is reduced to some extent along the three orbit trajectories L1 to L3 related to the center Op, the heat density at one time when irradiation with the beam Bp is performed such that the center Op orbits along each of the orbit trajectories L1 to L3 shows normal distribution. On the other hand, the amount of input heat T by the sum of the irradiations of the irradiation surface 38*a* of the target 38 with the beam Bp due to three-times orbits along the orbit trajectories L1 to L3 becomes the total amount of input heat to the irradiation surface 38*a* of the target 38 in each of the three-times orbits, and therefore, the amount of input heat T becomes substantially flat as shown in FIG. 4. In this manner, the diameter Dp of the beam Bp is made smaller than that in the one-time irradiation of the irradiation surface 38*a* of the target 38 with the beam Bp of the charged particles P and irradiation with beam Bp is performed multiple times such that the center Op follows different paths, whereby it is possible to make the amount of input heat to the target 38 flat regardless of a location. Further, when the amount of input heat can be made flat, neutrons can be evenly generated at each position of the target 38, and the generation of stress or the like can also be suppressed.

Figure 5:
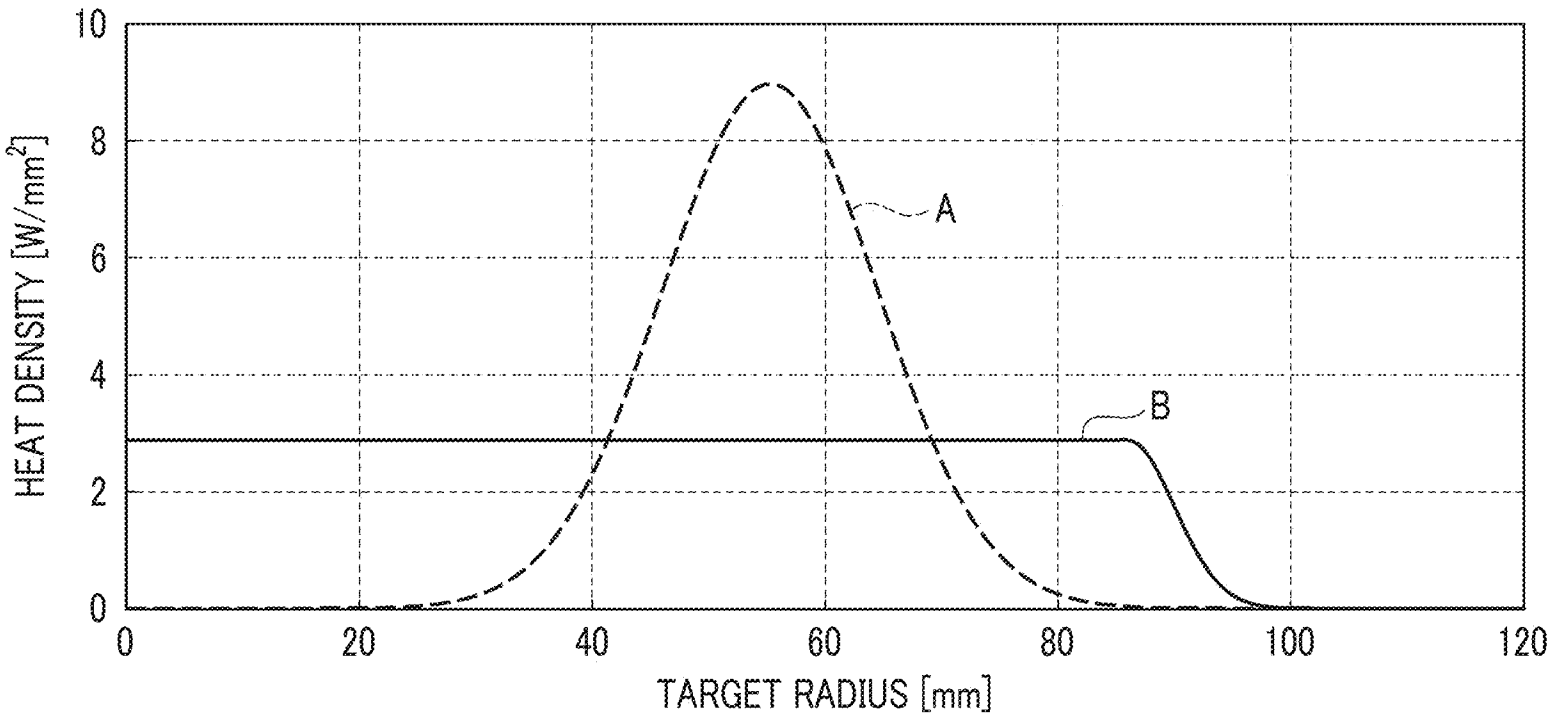
FIG. 5 is a diagram describing the distribution of the input heat by the charged particles with respect to the irradiation surface of the target.

FIG. 5 schematically shows a difference between the heat density of the input heat to the target 38 by a irradiation method with the beam of the charged particles P according to the related art and the heat density of the input heat to the target 38 by the irradiation method with the beam of the charged particles P according to this embodiment. The horizontal axis represents the radius of the irradiation surface 38*a* of the target 38, and the center O of the target 38 is assumed to be 0.

The heat density to the target 38 by the beam of the charged particles P is estimated to have normal distribution according to the distance from the center of the beam. At this time, when the diameter of the beam of the charged particles P increases, the heat density of the central portion also increases. For example, in FIG. 5, there is shown an example of a beam shape A of the beam in a case where the position of the radius of 55 mm from the center on the irradiation surface 38*a* of the target is a center position and the beam diameter is 50 mm. In this case, it can be seen that in the vicinity of the radius of 80 mm from the center on the irradiation surface 38*a* of the target, the heat density becomes 1/10 or less compared to a peak position (the radius of 55 mm from the center on the irradiation surface 38*a* of the target) and the beam of the charged particles P has not reached sufficiently. In this case, the outer peripheral portion of the target 38 is not sufficiently irradiated with the beam of the charged particles P, and therefore, neutrons are not sufficiently generated at that position. Similarly, it can be seen that in the vicinity of the radius of 30 mm from the center on the irradiation surface 38*a* of the target, the heat density becomes 1/10 or less compared to the peak position (the radius of 55 mm from the center on the irradiation surface 38*a* of the target) and the beam of the charged particles P has not reached sufficiently. In this case, the central portion of the target 38 is also not sufficiently irradiated with the beam of the charged particles P, and therefore, neutrons are not sufficiently generated at that position.

On the contrary, as in a beam shape B shown in FIG. 5, when irradiation with the beam of the charged particles P can be performed as evenly as possible from the center (0 mm) to the peripheral edge (110 mm) of the irradiation surface 38*a* of the target 38, the heat density can be made uniform regardless of a position on the target 38. Therefore, the total amount of input heat can be increased even if the heat density at a specific position does not increase.

As a method of making the heat density uniform, in this embodiment, by controlling the diameter of the beam Bp of the charged particles P and the irradiation path, a plurality of mountains (peaks) of the heat density formed by the beam are formed between the center and the end portion of the target 38 (the irradiation surface 38*a* thereof). As a result, as shown in FIG. 4, it is possible to reduce a difference in heat density (difference in the total result) according to a position on the target 38.

As described above, according to the irradiation control device 100 for charged particles described above, by causing the beam Bp of the charged particles P to orbit multiple times on the irradiation surface 38*a* of the target 38, a plurality of peaks of the heat density formed by the beam Bp are formed from the center to the end portion of the irradiation surface. As a result, it is possible to make the heat density related to the input heat to the target by the sum of a plurality of irradiations more uniform.

In the past, it has been studied to perform an orbit movement such that the center of the beam Bp draws a circular trajectory on the irradiation surface 38*a* of the target 38. However, when the diameter Dp of the beam Bp is increased so as to irradiate the target 38 with the beam Bp (such that the outside of the target 38 is not irradiated), a difference in heat density between the center and the peripheral edge of the beam Bp becomes large to some extent, and therefore, a further study is required. When a large bias occurs in the heat density at the time of the input heat by the irradiation with the beam Bp according to a location on the target 38, it is considered that the target 38 is damaged due to the influence of an uneven temperature rise of the target 38, the generation of thermal stress, or the like. Therefore, there is a problem that it is difficult to increase a beam current.

On the contrary, in the irradiation control device 100 described above, a plurality of peaks of the heat density formed by the beam Bp are formed from the center to the end portion of the irradiation surface by causing the beam Bp to orbit multiple times on the irradiation surface 38*a* of the target 38. As a result, it is possible to make the distribution of the heat density by the beam of the charged particles, which irradiates each position on the irradiation surface 38*a* of the target 38, more uniform. As a result, even a portion closer to the peripheral edge of the target 38 can be irradiated with the beam Bp of the charged particles P, as compared with the configuration of the related art, and thus the target 38 can be effectively used. Further, in this manner, when a difference in heat density at each position on the irradiation surface 38*a* becomes small, the deformation of the target 38 due to stress is also prevented, and therefore, even in a state where the beam current is increased, the irradiation with the beam Bp of the charged particles P can be performed while preventing damage to the target 38, or the like. Therefore, the amount of neutrons generated can also be increased, and for example, in the neutron capture therapy, it can also be expected to shorten a neutron irradiation time.

In the above embodiment, a plurality of peaks of the heat density formed by the beam are formed from the center of the target 38 to the end portion along the radial direction by causing the beam to "orbit multiple times". However, there is no limitation to a plurality of "orbits". As an example, even in a case where the path of the beam Bp (the path of the center Op of the beam Bp) is spiral, a plurality of peaks of the heat density formed by the beam Bp can be formed between the center and the end portion of the target 38. That is, according to the irradiation control device 100 for charged particles, by forming a plurality of peaks of the heat density formed by the beam Bp between the center and the end portion of the irradiation surface by moving the beam Bp of the charged particles P on the irradiation surface 38*a* of the target 38, it is possible to make the heat density related to the input heat to the target by the sum of a plurality of irradiations more uniform. In the above embodiment, as an example thereof, it is shown that the heat density related to the input heat to the target can be made uniform by providing a plurality of "orbit trajectories" by the center Op of the beam Bp with the center O of the irradiation surface 38*a* of the target 38 as the trajectory center $O_L$.

The control unit 130 as the controller may control the deflector to make the diameter Dp of the beam of the charged particles smaller than the radius of the irradiation surface 38*a* of the target 38. In this case, the irradiation region with the beam Bp of the charged particles P can be more finely adjusted, and as a result, the heat density related to the input heat by the beam Bp at each position can be more finely adjusted. That is, the irradiation path of the beam Bp (including, for example, the radius of the orbit trajectory, or the like) can be set such that the heat density on the irradiation surface 38*a* of the target 38 becomes more uniform. Therefore, it is possible to make the heat density related to the input heat to the target by the sum of a plurality of irradiations more uniform.

The number of orbit trajectories by the center Op of the beam Bp, the distance between the orbit trajectories, and the like are appropriately changed according to the diameter Dp of the beam Bp of the charged particles P. That is, the trajectory of the beam Bp (the path through which the center Op of the beam Bp moves) can be set based on the diameter Dp of the beam or the like such that the heat density related to the input heat to the target becomes substantially uniform.

The control unit 130 as the controller may control the deflector to change the rotational speed of the beam Bp (the movement speed of the beam Bp with respect to the irradiation surface 38*a*) between the center and the end portion of the target 38. The heat density of the input heat by the beam Bp may be changed according to the length of the time when a specific position is irradiated with the beam Bp. In other words, the rotational speed (movement speed) of the beam Bp with respect to the target 38 affects the heat density related to the input heat to the target 38. Therefore, by changing the rotational speed of the beam, the heat density related to the input heat to the target can be adjusted to become more uniform.

For example, in the example of the above embodiment, it is conceivable that the rotational speed of the beam when orbiting along each of the orbit trajectories L1 to L3 is changed according to the orbit trajectories L1 to L3 of the beam Bp. As shown in FIG. 3, in a case of causing the beam Bp to orbit along the orbit trajectories L1 to L3 on the target 38, it is conceivable that the heat density can be made more uniform by making the movement speed of the beam Bp along the trajectory uniform. Therefore, by making the time required for one revolution in the case of the irradiation with the beam Bp along the longer orbit trajectory L1 longer than the time required for one revolution in the case of the irradiations with the beam Bp along the orbit trajectories L2 and L3 that are shorter, it is possible to make the heat density more uniform.

In a case where the rotational speed of the beam Bp on the irradiation surface 38*a* (the time required per one revolution when the beam Bp orbits along the orbit trajectory) is the same, it is possible to make the heat density more uniform even in a case where the number of rotations at each orbit trajectory is changed. For example, the orbit of the beam Bp along the orbit trajectory L1 is once, whereas the orbit of the beam Bp along the orbit trajectory L3 is set to three times. In this case, in the orbit along the orbit trajectory L3, even in a case where the movement speed of the beam Bp with respect to the irradiation surface 38*a* is faster than that in the orbit along the orbit trajectory L1, the same irradiation region is irradiated with the beam Bp multiple times, so that it is possible to make the heat density related to the input heat to the target by the sum of the beam irradiations with respect to the irradiation surface more uniform. In this manner, the heat density related to the input heat may be adjusted by changing the movement speed of the beam Bp or the number of times of irradiations of the same irradiation region with the beam Bp.

The present disclosure is not limited to the embodiment described above, and various modifications can be made.

For example, in this embodiment, the beam of the charged particles is expanded into a circular shape. However, various shapes other than the circular shape may be adopted. Further, in this embodiment, the trajectory of the orbit movement of the charged particles is set to be a circular shape. However, various orbit trajectories other than the circular trajectory can be applied.

Further, the target 38 is not limited to beryllium (Be), and tantalum (Ta), lithium (Li), or the like can also be used. Also in this case, the irradiation control device for charged particles according to the present disclosure exhibits the effects. Further, the shape of the target 38 is not limited to a circular shape and can be changed appropriately.

It should be understood that the invention is not limited to the above-described embodiment, but may be modified into various forms on the basis of the spirit of the invention. Additionally, the modifications are included in the scope of the invention.

What is claimed is:

1. An irradiation control device which controls irradiation of charged particles to a target that includes a substance that generates neutrons by being irradiated with a charged particle beam, comprising:

a deflector that deflects the charged particles; and a controller that controls the deflector such that a plurality of peaks of heat density formed by the beam are formed between a center of an irradiation surface of the target and an end portion of the irradiation surface by moving the beam of the charged particles on the irradiation surface of the target.

2. The irradiation control device for charged particles according to claim 1, wherein the controller controls the deflector to make a diameter of the beam of the charged particles smaller than a radius of the irradiation surface.

3. The irradiation control device for charged particles according to claim 1, wherein the controller controls the deflector to change a movement speed of the beam or the number of times of irradiations of the same irradiation region between a center side and an end portion side of the irradiation surface.

4. The irradiation control device for charged particles according to claim 3, wherein the controller controls the deflector to cause the beam of the charged particles to orbit multiple times such that a center of the beam of the charged particles draws a plurality of circular trajectories having different radii with the center of the irradiation surface as a trajectory center on the irradiation surface.

5. The irradiation control device for charged particles according to claim 4, wherein a time required for one revolution in a case of irradiating with the beam along a first orbit trajectory is set to be longer than a time required for one revolution in a case of irradiating with the beam along a second orbit trajectory that is shorter than the first orbit trajectory.

6. The irradiation control device for charged particles according to claim 4, wherein the number of times of orbits of the beam along a first orbit trajectory is set to be smaller than the number of times of orbits of the beam along a second orbit trajectory that is shorter than the first orbit trajectory.

7. The irradiation control device for charged particles according to claim 3, wherein the controller controls the deflector to move the beam of the charged particles such that a center of the beam of the charged particles draws a spiral trajectory with the center of the irradiation surface as a trajectory center on the irradiation surface.

8. The irradiation control device for charged particles according to claim 1, wherein the deflector includes a first-direction deflection unit that deflects and emits incident charged particles in a first direction, and a second-direction deflection unit that deflects and emits incident charged particles in a second direction intersecting the first direction.

9. The irradiation control device for charged particles according to claim 8, wherein the first-direction deflection unit and the second-direction deflection unit include electromagnets.

* * * * *